US009139007B2

(12) United States Patent
Onodera et al.

(10) Patent No.: US 9,139,007 B2
(45) Date of Patent: Sep. 22, 2015

(54) HEAD CLEANING METHOD AND LIQUID DISCHARGING APPARATUS

(71) Applicant: SEIKO EPSON CORPORATION, Tokyo (JP)

(72) Inventors: Katsuyoshi Onodera, Chino (JP); Norihiro Masuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/219,238

(22) Filed: Mar. 19, 2014

(65) Prior Publication Data

US 2014/0292916 A1 Oct. 2, 2014

(30) Foreign Application Priority Data

Mar. 27, 2013 (JP) ..... 2013-065769

(51) Int. Cl.
*B41J 2/165* (2006.01)
*B41J 2/18* (2006.01)

(52) U.S. Cl.
CPC ..... *B41J 2/16538* (2013.01); *B41J 2/16585* (2013.01); *B41J 2/18* (2013.01); *B41J 2002/16573* (2013.01)

(58) Field of Classification Search
CPC ..... B41J 2/16538; B41J 2/16535; B41J 2/16585; B41J 2/16547; B41J 2/16541
USPC ..... 347/33, 22
See application file for complete search history.

(56) References Cited

U.S. PATENT DOCUMENTS

| | | | | |
|---|---|---|---|---|
| 5,310,801 | A * | 5/1994 | Hayashi et al. | 525/198 |
| 6,336,699 | B1 * | 1/2002 | Sarkissian et al. | 347/33 |
| 2009/0051724 | A1 * | 2/2009 | Katoh | 347/18 |
| 2010/0321425 | A1 * | 12/2010 | Kanke et al. | 347/6 |

FOREIGN PATENT DOCUMENTS

| | | | | |
|---|---|---|---|---|
| JP | 03-099857 | * | 4/1991 | B41J 2/165 |
| JP | 2011-005672 | | 1/2011 | |

* cited by examiner

*Primary Examiner* — Manish S Shah
*Assistant Examiner* — Yaovi Ameh
(74) *Attorney, Agent, or Firm* — Workman Nydegger

(57) ABSTRACT

There is provided a head cleaning method in a liquid discharging apparatus which includes a head, a storage section that stores liquid, a circulation flow path that includes a first flow path which supplies the liquid from the storage section to the head and a second flow path which refluxes the liquid from the head to the storage section, a circulation pump, and a wiping section. The head cleaning method includes: a first step of setting a flow rate per unit time of the liquid which flows through the circulation flow path to a first flow rate which is greater than a flow rate in a case in which the liquid is discharged to the recording medium; a second step of the wiping section performing the wiping process after the first step; and a third step of setting the flow rate per unit time of the liquid which flows through the circulation flow path to a second flow rate which is lower than the first flow rate after the second step.

6 Claims, 8 Drawing Sheets

HEAD CLEANING METHOD AND LIQUID DISCHARGING APPARATUS

BACKGROUND

1. Technical Field

The present invention relates to a head cleaning method and a liquid discharging apparatus.

2. Related Art

An ink jet printer (hereinafter, referred to as a printer) which discharges ink (liquid) from nozzles provided in a head is known as an example of a liquid discharging apparatus. In the printer, since ink or dust adheres to the nozzle opening surface of the head, a wiping process to wipe off the ink or dust from the nozzle opening surface using a wiper is periodically performed. In order to easily wipe off dust which adheres to the nozzle opening surface while ink is suppressed from being consumed during the wiping process, a method of performing the wiping process by pressurizing ink in an ink supply path to overflow the ink from the nozzle opening surface and stopping the pressurization of the ink is proposed (refer to JP-A-2011-5672).

There is a case in which ink in the nozzles follows ink which adheres to the wiper and is drawn to the wiper during the wiping process. In JP-A-2011-5672, the wiping process is performed in a state in which the pressurization of the ink in the ink supply path is stopped. Therefore, even if the ink in the nozzles is drawn by the wiper, it is not possible to replenish the nozzles with ink. As a result, bubbles remain in the nozzles, and thus discharge failure occurs.

SUMMARY

An advantage of some aspects of the invention is to suppress the occurrence of ink discharge failure from nozzles while making the nozzle opening surface of a head clean.

According to an aspect of the invention, there is provided a head cleaning method in a liquid discharging apparatus which includes a head that is provided with nozzles which discharge liquid to a recording medium, a storage section that stores the liquid, a circulation flow path that includes a first flow path which supplies the liquid from the storage section to the head and a second flow path which refluxes the liquid from the head to the storage section, a pump that circulates the liquid in the circulation flow path, and a wiping section that performs a wiping process to wipe off contaminants which adhere to a nozzle opening surface by relatively moving with regard to the head while being abutted on the nozzle opening surface of the head, the head cleaning method including: a first step of setting a flow rate per unit time of the liquid which flows through the circulation flow path to a first flow rate which is greater than a flow rate in a case in which the liquid is discharged to the recording medium; a second step of the wiping section performing the wiping process after the first step; and a third step of setting the flow rate per unit time of the liquid which flows through the circulation flow path to a second flow rate which is lower than the first flow rate after the second step.

The other features of the invention will be apparent based on the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview of Disclosure

Figure 1A:
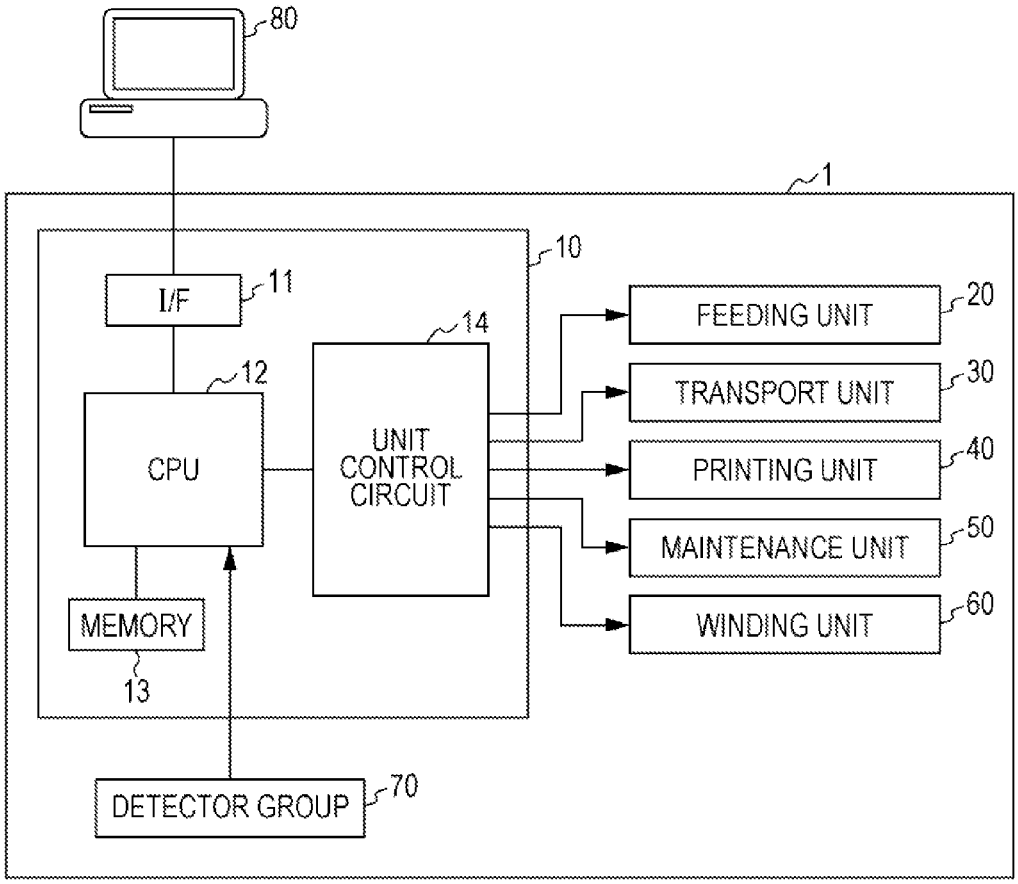
FIG. 1A is a block diagram illustrating the entire configuration of a printing system.

At least the following configurations will be apparent with the specification and the accompanying drawings.

According to an aspect of the invention, there is provided a head cleaning method in a liquid discharging apparatus which includes a head that is provided with nozzles which discharges liquid to a recording medium, a storage section that stores the liquid, a circulation flow path that includes a first flow path which supplies the liquid from the storage section to the head and a second flow path which refluxes the liquid from the head to the storage section, a pump that circulates the liquid in the circulation flow path, and a wiping section that performs a wiping process to wipe off contaminants which adhere to a nozzle opening surface by relatively moving with regard to the head while being abutted on the nozzle opening surface of the head, the head cleaning method including: a first step of setting a flow rate per unit time of the liquid which flows through the circulation flow path to a first flow rate which is greater than a flow rate in a case in which the liquid is discharged to the recording medium; a second step of the wiping section performing the wiping process after the first step; and a third step of setting the flow rate per unit time of the liquid which flows through the circulation flow path to a second flow rate which is lower than the first flow rate after the second step.

In the head cleaning method according to the aspect, the nozzles are filled with the liquid and menisci of the liquid which are formed in the nozzles reach proper states when the liquid is discharged to the recording medium, thus it is possible to terminate a cleaning process.

In the head cleaning method according to the aspect, the second step may include causing menisci of the liquid formed in the nozzles to protrude outside of the head rather than the nozzle opening surface, and the third step may include causing the menisci to be drawn inside of the head rather than the nozzle opening surface.

In the head cleaning method according to the aspect, the nozzles are filled with the liquid and menisci of the liquid which are formed in the nozzles reach proper states when the liquid is discharged to the recording medium, thus it is possible to terminate a cleaning process.

In the head cleaning method according to the aspect, the flow rate per unit time of the liquid which flows through the circulation flow path in a case in which the liquid is discharged to the recording medium may be equal to the second flow rate.

In the head cleaning method according to the aspect, it is possible to start an operation of discharging the liquid to the recording medium immediately after the third step is performed.

In the head cleaning method according to the aspect, the first step may include setting the flow rate per unit time of the liquid which flows through the circulation flow path to the first flow rate by setting a feed rate of the liquid by the pump to a first feed rate, and the third step may include setting the feed rate of the liquid by the pump to a second feed rate which is lower than the first feed rate.

In the head cleaning method according to the aspect, it is possible to set the flow rate per unit time of the liquid which flows through the circulation flow path to the second flow rate which is lower than the first flow rate by performing the third step.

In the head cleaning method, the liquid discharging apparatus may include a pressure adjustment section that adjusts pressure in the storage section, the first step may include setting the flow rate per unit time of the liquid which flows through the circulation flow path to the first flow rate by setting the pressure in the storage section to first pressure by the pressure adjustment section, and the third step may include setting the pressure in the storage section to second pressure which is lower than the first pressure by the pressure adjustment section.

In the head cleaning method according to the aspect, it is possible to set the flow rate per unit time of the liquid which flows through the circulation flow path to the second flow rate which is lower than the first flow rate by performing the third step.

In addition, according to another aspect of the invention, there is provided a liquid discharging apparatus including: a head that is provided with nozzles which discharges liquid to a recording medium; a storage section that stores the liquid; a circulation flow path that includes a first flow path which supplies the liquid from the storage section to the head and a second flow path which refluxes the liquid from the head to the storage section; a pump that circulates the liquid in the circulation flow path; a wiping section that performs a wiping process to wipe off contaminants which adhere to a nozzle opening surface by relatively moving with regard to the head while being abutted on the nozzle opening surface of the head; and a control section that sets a flow rate per unit time of the liquid which flows through the circulation flow path to a first flow rate which is greater than a flow rate in a case in which the liquid is discharged to the recording medium, and causes the wiping section to perform the wiping process thereafter, and then sets the flow rate per unit time of the liquid which flows through the circulation flow path to a second flow rate which is lower than the first flow rate.

In the liquid discharging apparatus according to the aspect, the nozzles are filled with the liquid and menisci of the liquid which are formed in the nozzles reach proper states when the liquid is discharged to the recording medium, thus it is possible to terminate a cleaning process.

Printing System

Hereinafter, it is assumed that a liquid discharging apparatus is an ink jet printer (hereinafter, referred to as a printer), and embodiments will be described using a printing system in which a computer is connected to the printer as an example.

Figure 1B:
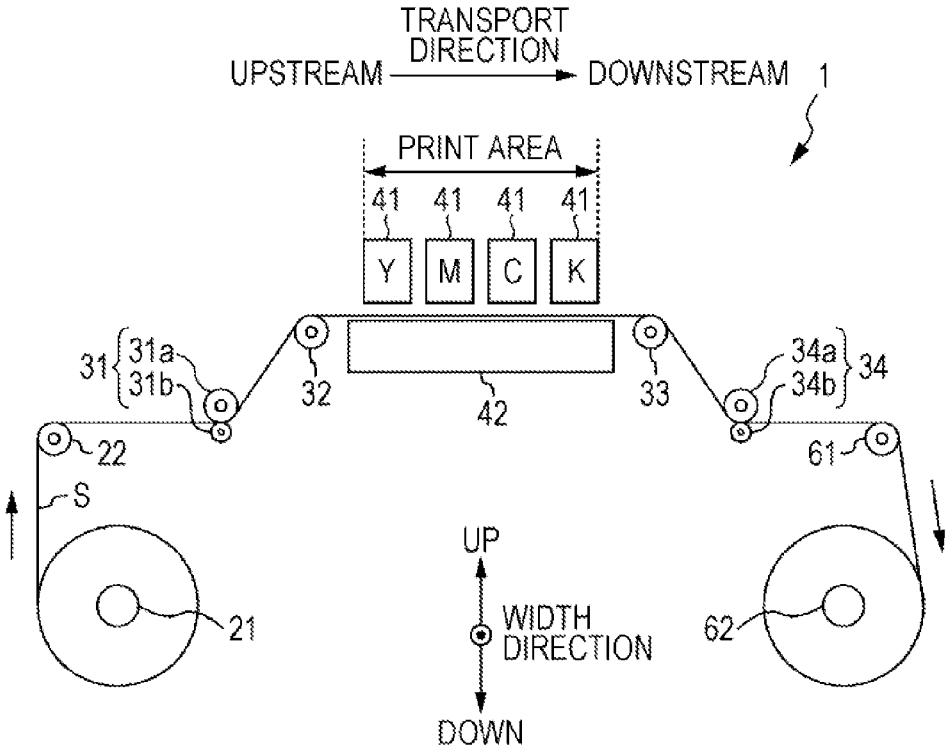
FIG. 1B is a schematic sectional diagram illustrating a printer.
Figure 2:
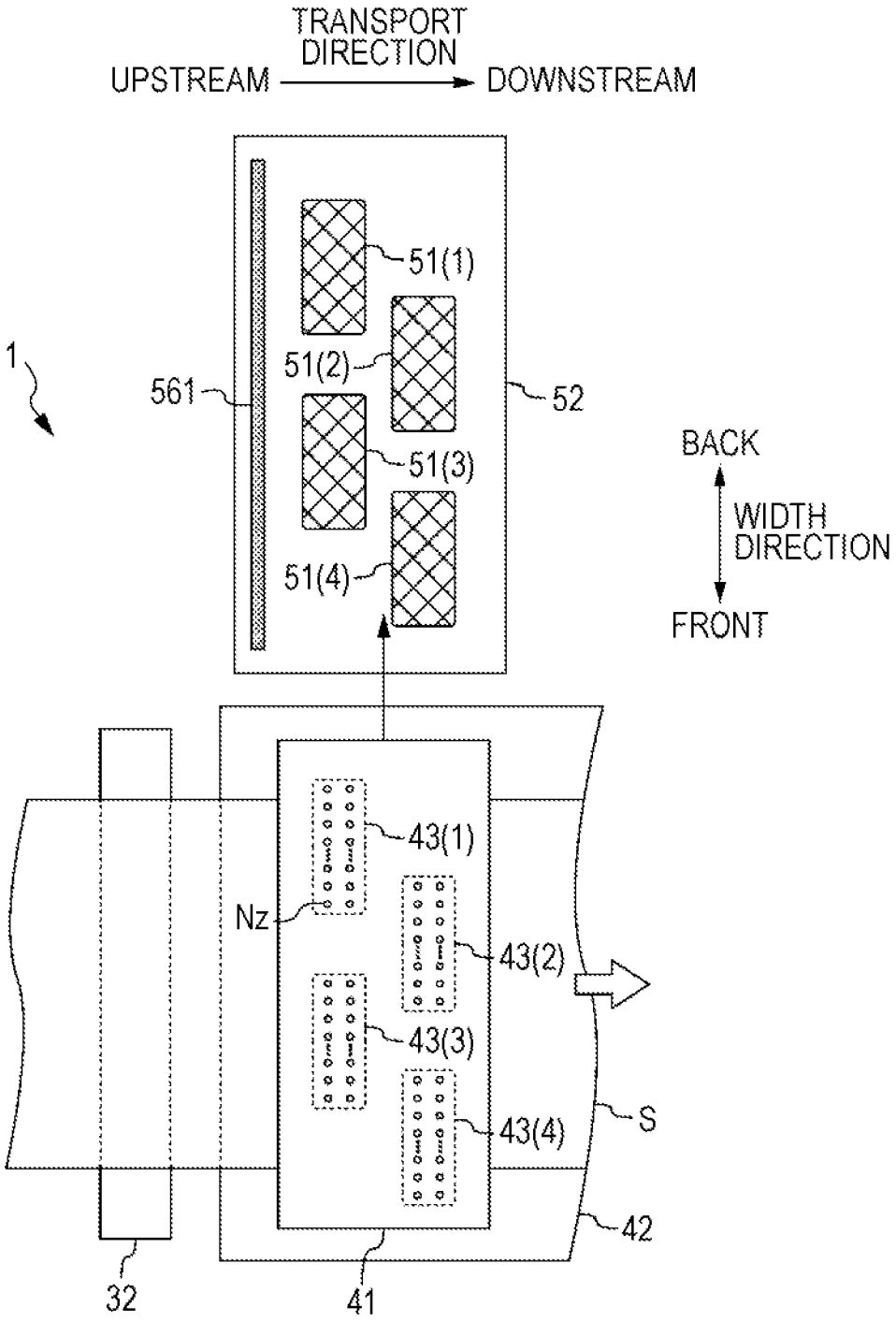
FIG. 2 is a schematic top view illustrating the printer.
Figure 3:
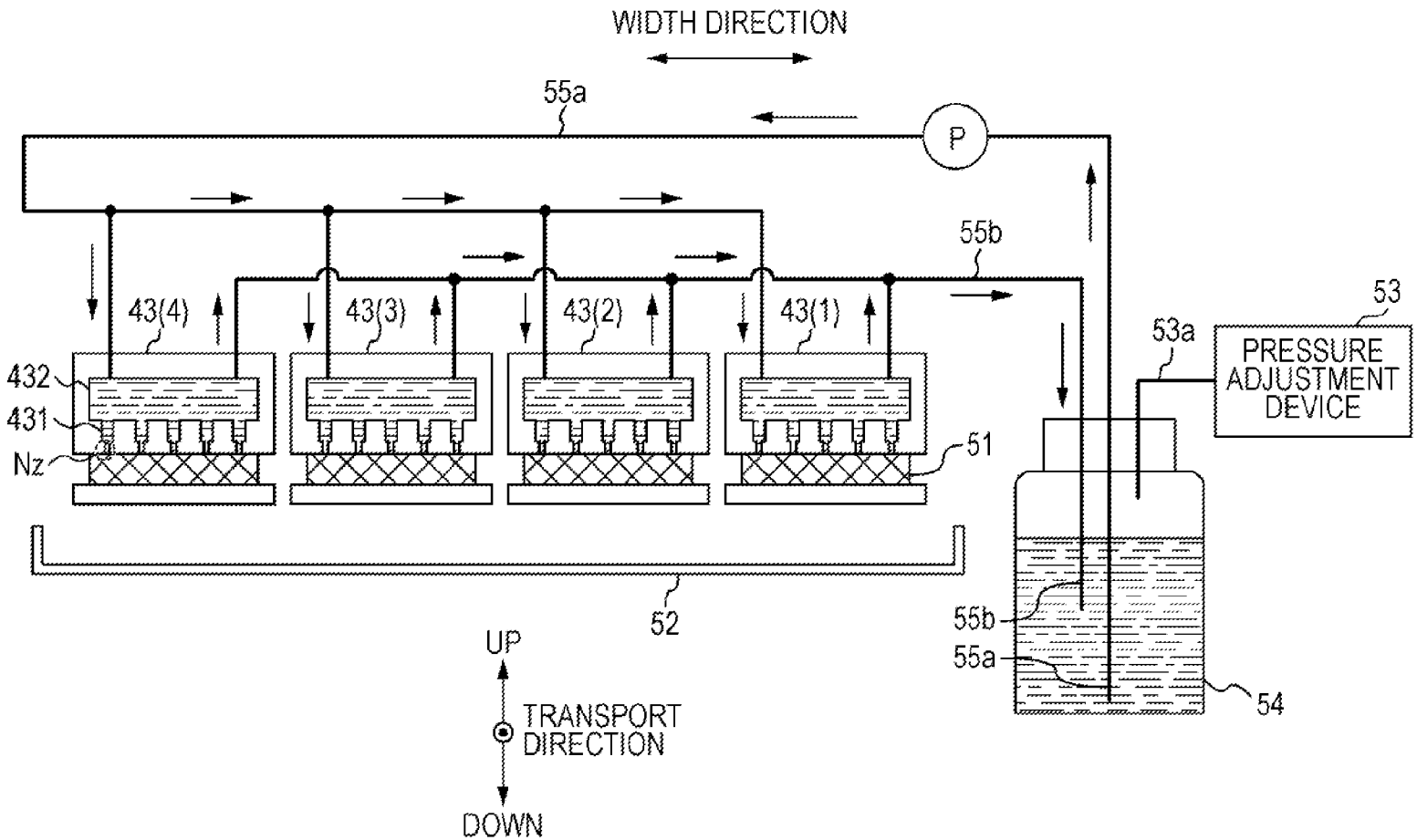
FIG. 3 is an explanatory diagram illustrating an ink circulation system in the printer.

FIG. 1A is a block diagram illustrating the entire configuration of a printing system, and FIG. 1B is a schematic sectional diagram illustrating a printer 1. FIG. 2 is a schematic top view illustrating the printer 1. FIG. 3 is an explanatory diagram illustrating an ink circulation system in the printer 1. The printer 1 is communicably connected to a computer 80, and a printer driver, which is installed in the computer 80, prepares printing data in order to cause the printer 1 to print an image and outputs the printing data to the printer 1. The printer 1 includes a controller 10, a feeding unit 20, a transport unit 30, a printing unit 40, a maintenance unit 50, a winding unit 60, and a detector group 70.

The controller 10 included in the printer 1 is a unit which performs overall control on the printer 1. An interface section 11 performs data transmission and reception with the computer 80 which is provided as an external apparatus or an internal apparatus. A CPU 12 is an arithmetic processing unit in order to perform overall control on the printer 1, and controls each unit through a unit control circuit 14. A memory 13 secures an area which stores programs of the CPU 12 or a work area. A detector group 70 monitors situations in the printer 1, and the controller 10 performs control based on a result of the detection from the detector group 70.

The feeding unit 20 includes a winding shaft 21 which rotatably supports a continuous sheet, which is rolled in a roll shape (hereinafter, referred to as continuous sheet), and sends the continuous sheet S out based on rotation, and a relay roller 22 which winds up the continuous sheet S sent out from the winding shaft 21 and introduces the continuous sheet S through a pair of upstream side transport rollers 31. Meanwhile, a recording medium on which an image is printed by the printer 1 is not limited to the continuous sheet S. The recording medium may be cut sheet, cloth, a film, and the like.

The transport unit 30 includes a plurality of relay rollers 32 and 33 which wind up and transmit the continuous sheet S, the pair of upstream side transport rollers 31 which are arranged on the upstream side of the transport direction compared to a printing area, and a pair of downstream side transport rollers 34 which are arranged on the downstream side of the transport direction compared to the printing area. The pair of upstream side transport rollers 31 and the pair of downstream side transport rollers 34 include driver rollers 31*a* and 34*a* which are connected to a motor (not shown in the drawing) and driven and rotated, and follower rollers 31*b* and 34*b* which rotate in accordance with the rotation of the driver rollers, respectively. Further, when the driver rollers 31*a* and 34*a* are driven and rotated in a state in which the pair of upstream side transport rollers 31 and the pair of downstream side transport rollers 34 interpose the continuous sheet S, respectively, transport force is applied to the continuous sheet S.

The printing unit 40 includes head units 41 which are provided for the respective ink colors, and a platen 42 which supports the continuous sheet S from the surface opposite to a printed surface in the printing area. The printer 1 according to the embodiment can discharge four-colored ink, that is, yellow (Y), magenta (M), cyan (C), and black (K), and the four head units 41 are arranged in the transport direction as shown in FIG. 1B. In each head unit 41, a plurality of short heads 43(1) to 43(4) are arranged in the width direction which crosses the transport direction of the continuous sheet S, as shown in FIG. 2. On a surface (bottom surface) of each head 43, which faces the continuous sheet S, a plurality of nozzles Nz (for example, nozzles having a diameter of approximately 20 to 22 μm) which discharge ink are arranged in the width direction at predetermined intervals. Meanwhile, FIG. 2 virtually illustrates the positions of the short heads 43 and the nozzles Nz when the head units 41 are viewed from above. Further, the positions of the end nozzles Nz of the heads which are arranged in the width direction are partially overlapped. On the bottom surface of the head unit 41, the nozzles Nz are arranged in the width direction at predetermined intervals over the width length of the continuous sheet. Therefore, ink is discharged from the nozzles Nz to the continuous sheet S which is transported under the head units 41 without stopping, and thus a 2-dimensional image is printed on the continuous sheet S.

In addition, as shown in FIG. 3, each head 43 is provided with the plurality of nozzles Nz, a plurality of piezoelectric elements (not shown in the drawing) which are provided for the respective nozzles Nz, a plurality of ink chambers 431 which are provided for the respective nozzles Nz to communicate with the respective nozzles Nz, and common ink chambers 432 which communicate with the plurality of ink chambers 431. Further, when ink chambers 431 are expanded and contracted by applying a voltage to the piezoelectric elements, ink is discharged from the nozzles Nz. However, a method of discharging ink is not limited thereto, and there is a thermal method of generating bubbles in the nozzles using heating elements and discharging ink from the nozzles using the bubbles.

Meanwhile, although the number of heads 43 included in the head unit 41 is set to four in the embodiment, the invention is not limited thereto. In addition, the invention may be applied to a printer that uses a rotating drum, which rotates using the width direction as a rotating shaft, as the platen, and that discharges ink from the heads while the continuous sheet S is wound by the rotating drum and is transported. In this case, the heads are arranged to be inclined along the circular arc-shaped peripheral surface of the rotating drum. In addition, if ink which is discharged from the heads 43 is, for example, UV ink that hardens when ultraviolet rays are irradiated, irradiators which irradiate ultraviolet rays are provided between the head units 41 and on the downstream side of the transport direction.

The maintenance unit 50 supplies ink to the heads 43 or cleans the heads 43, and includes caps 51 which adhere to the heads 43, an ink reception section 52, a pressure adjustment device 53, an ink tank 54 (corresponding to a storage section) which stores ink, an outgoing tube 55*a* (corresponding to a first flow path) which supplies ink from the ink tank 54 to the heads 43, a returning tube 55*b* (corresponding to a second flow path) which refluxes ink from the heads 43 to the ink tank 54, a wiping section 56, and a circulation pump P, as shown in FIGS. 2 and 3. The caps 51, the ink reception section 52, and the like are provided in a non-printing area on the back side in the width direction compared to an area to which the continuous sheet S is transported, and the head units 41 are configured to be able to move in the width direction. Meanwhile, since the configurations shown in FIGS. 2 and 3 are common configuration regardless of the colors of ink, the description thereof will not be repeated.

The caps 51 are rectangular members which are formed of elastic members or the like, and are provided for the respective heads 43. Further, the caps 51(1) to 51(4) are arranged in the width direction in accordance with the arrangement of the heads 43(1) to 43(4) in the head unit 41. Therefore, the heads 43 and the caps 51 face each other when the head unit 41 moves back side of the width direction, and the caps 51 adhere to the nozzle opening surfaces of the heads 43 when the head unit 41 descends (or the caps 51 ascend). Therefore, it is possible to seal the nozzles Nz. The ink reception section 52 receives ink which is discharged from the nozzles Nz when the heads 43 is cleaned.

The outgoing tube 55*a* has one end which is connected with the ink tank 54 and the other end which is connected with the heads 43. The returning tube 55*b* has one end which is connected with the heads 43 and the other end which is connected with the ink tank 54. A circulation flow path is formed by the heads 43, the ink tank 54, the outgoing tube 55*a*, and the returning tube 55*b*. A circulation pump P (corresponding to a pump) which circulates ink in the circulation flow path is provided in the middle of the outgoing tube 55*a*. When the circulation pump P is driven, ink is circulated in the order of the ink tank 54, the outgoing tube 55*a*, the heads 43, the returning tube 55*b*, and the ink tank 54, and ink in the ink tank 54 is supplied to the heads 43. When the ink is circulated, it is possible to make the concentration of ink uniform by stirring ink that includes a color material which easily settles, it is possible to maintain the temperature of ink using a heater or a deaeration device, which is provided in the middle of the circulation flow path but not shown in the drawing, and it is possible to remove bubbles from ink. Meanwhile, a configuration may be used in which the ink tank 54 is used as a sub tank and ink is supplied to the ink tank 54 from a tank (ink cartridge or the like) on the upstream side compared to the ink tank 54. In addition, the circulation pump P may be provided in the returning tube 55*b*.

In the embodiment, the circulation pump P is used as a gear pump and the circulation pump P is rotated in the forward direction, and thus ink is transmitted to the heads 43 from the ink tank 54 through the outgoing tube 55*a*. However, the circulation pump P is not limited to the gear pump, and, for example, a tube pump or the like may be used. In addition, the number of rotations of the circulation pump P is variable. When the number of rotations of the circulation pump P is adjusted, it is possible to change the transfer quantity (feed rate) of ink per unit time by the circulation pump P in a plurality of steps.

The pressure adjustment device 53 (corresponding to a pressure adjustment section) is used to adjust pressure in the ink tank 54. The pressure adjustment device 53 reduces pressure in the ink tank 54 by extracting air from the ink tank 54 through the air tube 53*a* which has one end provided in the air space of the ink tank 54 or applies pressure in the ink tank 54 by supplying air to the ink tank 54. In addition, it is possible for the pressure adjustment device 53 to change the pressure in the ink tank 54 into a plurality of stages.

The winding unit 60 includes a relay roller 61 that winds up and transmits the continuous sheet transmitted from the pair of downstream side transport rollers 34, and a winding drive shaft 62 that winds up the continuous sheet S which is transmitted from the relay roller 61. A printed continuous sheet S is sequentially wound in a roll shape in accordance with the rotary drive of the winding drive shaft 62.

Method of Cleaning Heads 43

When ink is discharged from the nozzles Nz, minute ink droplets are generated together with main ink droplets, and the minute ink droplets float up as mist and adhere to the nozzle opening surfaces of the heads 43. In addition, paper powder or dust adheres to the nozzle opening surfaces of the heads 43 in addition to ink. When contaminants are left and deposited while the contaminants adhere to the nozzle opening surfaces of the heads 43, the nozzles Nz are blocked, and thus discharge of ink from the nozzles Nz is inhibited. For example, a fixed amount of ink is not discharged from the nozzles Nz or a direction in which ink discharged from the nozzles Nz flies is deviated. As a result, the quality of a printed image is deteriorated.

Figure 6A:
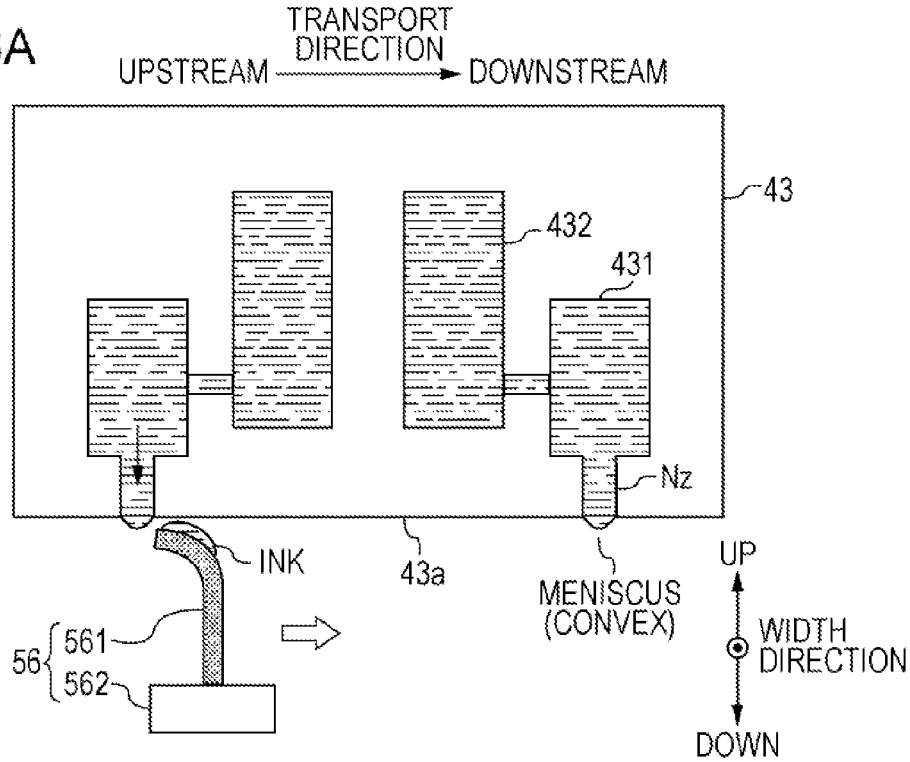
FIGS. 6A and 6B are views illustrating the method of cleaning the head according to the first embodiment.

Here, the printer 1 according to the embodiment periodically performs a "wiping process" performed by the wiping section 56 as a method of cleaning the head 43. As shown in FIG. 6A which will be described later, the wiping section 56 includes a wiper 561 that is an elastic member or a plate-shaped member which is formed of cloth, felt or the like, and a movement mechanism 562 which moves the wiper 561 in the transport direction to the head 43. Further, when the controller 10 (corresponding to a control section) in the printer 1 moves the wiper 561 in the transport direction to the head 43 in a state in which the tip part of the wiper 561 abuts on the nozzle opening surface 43*a* of the head 43, a wiping process to wipe off contaminants of ink, which adhere to the nozzle opening surface 43*a* of the head 43, is performed.

Meanwhile, in the embodiment, as shown in FIG. 2, one wiper 561 is provided for one head unit 41, and the length of the wiper 561 in the width direction is equal to or greater than the total length of the four heads 43 which are arranged in the width direction in the head unit 41. Therefore, it is possible for the wiper 561 to wipe the entire nozzle opening surface of four heads 43 which are included in the head unit 41 in such a way that the wiper 561 moves in the transport direction one time. However, the invention is not limited thereto. The wiper 561 may be provided for each head 43, and only one wiper 561 may be provided for four head units 41. In addition, the head unit 41 may be moved in the transport direction for the wiper 561, and both the wiper 561 and the head unit 41 may be moved.

Comparison Example

Figure 4:
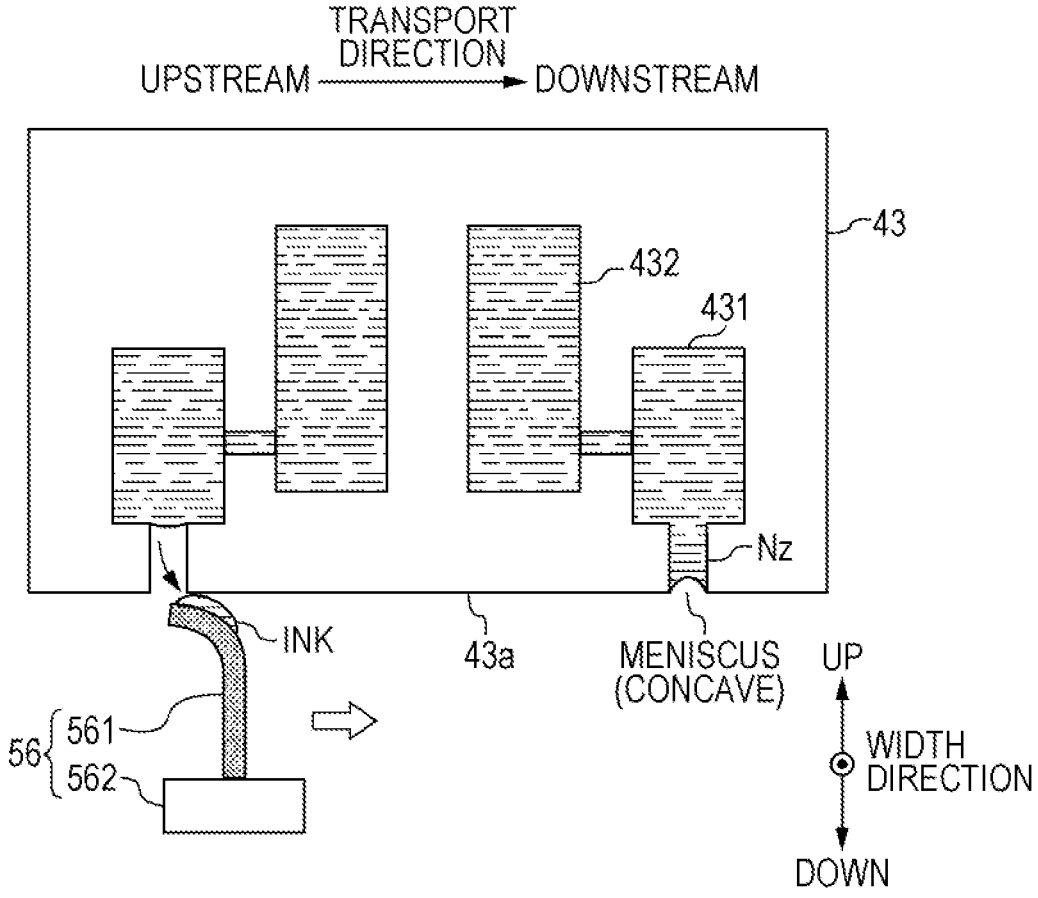
FIG. 4 is an explanatory diagram illustrating a wiping process according to a comparison example.

FIG. 4 is an explanatory diagram illustrating a wiping process according to a comparison example. When an image is printed on the continuous sheet S, the menisci of ink (the free surface of ink which is exposed from the nozzles Nz) which are formed in the nozzles Nz have a concave shape which is drawn inside of the head 43. If the menisci become concave states, it is possible to appropriately control the discharge and non-discharge when the discharge of ink is controlled using a piezoelectric element. Therefore, when an image is printed, pressure is not applied to ink in the nozzles Nz such that the menisci which are formed in the nozzles Nz become the concave states. More specifically, the circulation pump P is rotated at a low speed (the number of rotation per unit time is set to N0), the transfer quantity of ink per unit time by the circulation pump P is set to a relatively small quantity (q0), and the pressurization of the ink tank 54 performed by the pressure adjustment device 53 is set to an off-state, and thus pressure in the ink tank 54 is set to a relatively low value (P0). In this way, a state becomes a "low-speed circulation" state in which the flow rate (Q0) per unit time of ink which flows through the circulation flow path (the outgoing tube 55*a*, the returning tube 55*b*, and the head 43) is low.

In the comparison example, the wiping process is performed in the "low-speed circulation" state when an image is printed. That is, in a state in which pressure is not applied to ink in the nozzles Nz, the wiping process is performed. However, when the wiping process is performed, there is a case in which ink in the nozzles Nz is guided by ink which adheres to the wiper 561 and drawn by the wiper 561. Therefore, when the flow rate per unit time of ink which flows through the circulation flow path is small and pressure is not applied to ink in the nozzles Nz, ink in the nozzles Nz is not replenished and bubbles remain in the nozzles Nz even when ink in the nozzles Nz is drawn by the wiper 561. If so, ink is not discharged from the nozzles Nz when an image is printed, with the result that discharge failure occurs, and thus the image quality of the printed image is deteriorated.

Here, in the embodiment, the wiping process is performed, and thus there are advantages in that the nozzle opening surface 43*a* of the head 43 is cleaned by removing contaminants, such as ink, from the nozzle opening surface 43*a* of the head 43 and in that the generation of the failure of ink discharge from the nozzles Nz is suppressed.

First Embodiment

Figure 5:
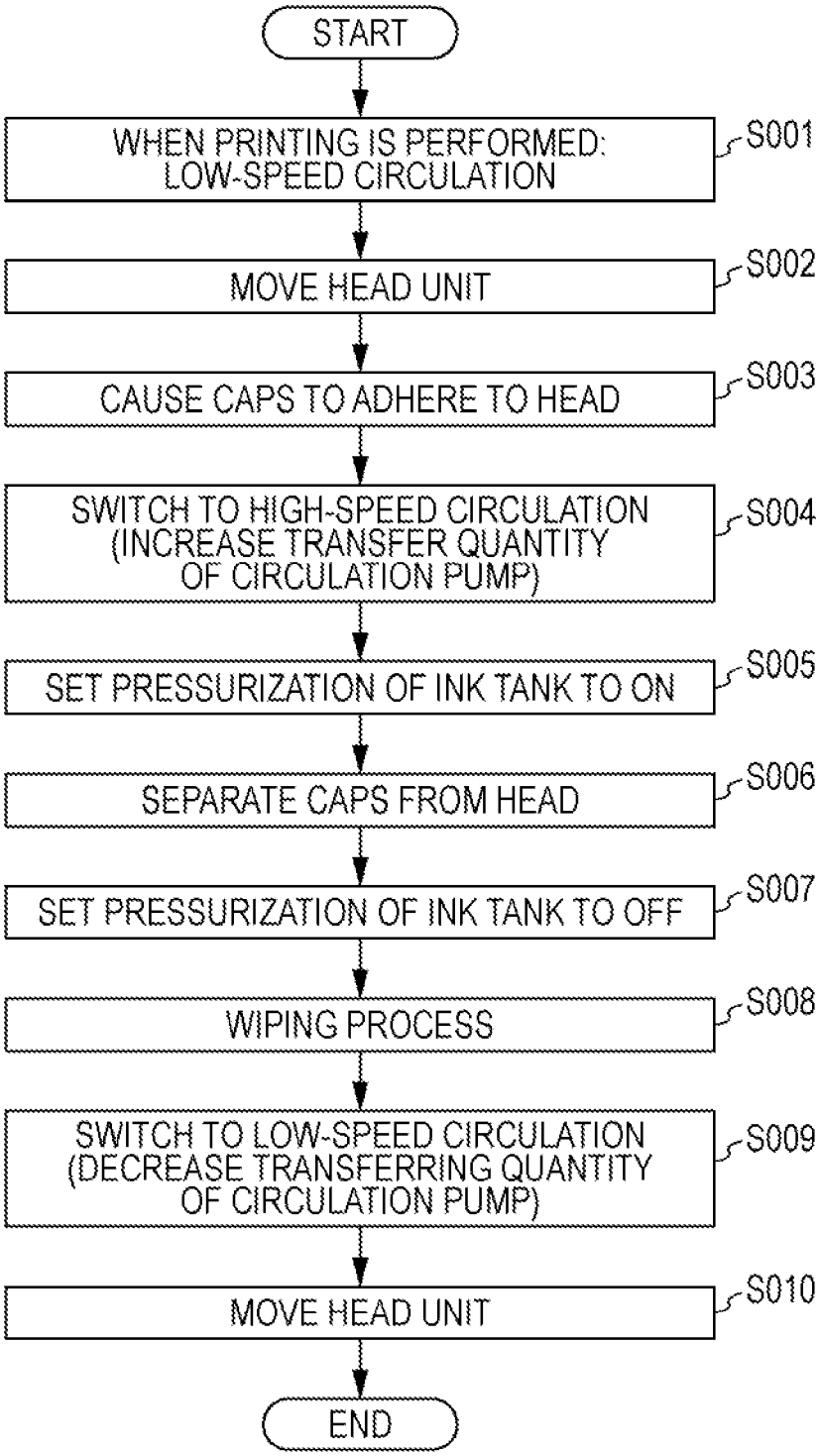
FIG. 5 is a flowchart illustrating a method of cleaning a head according to a first embodiment.
Figure 6B:
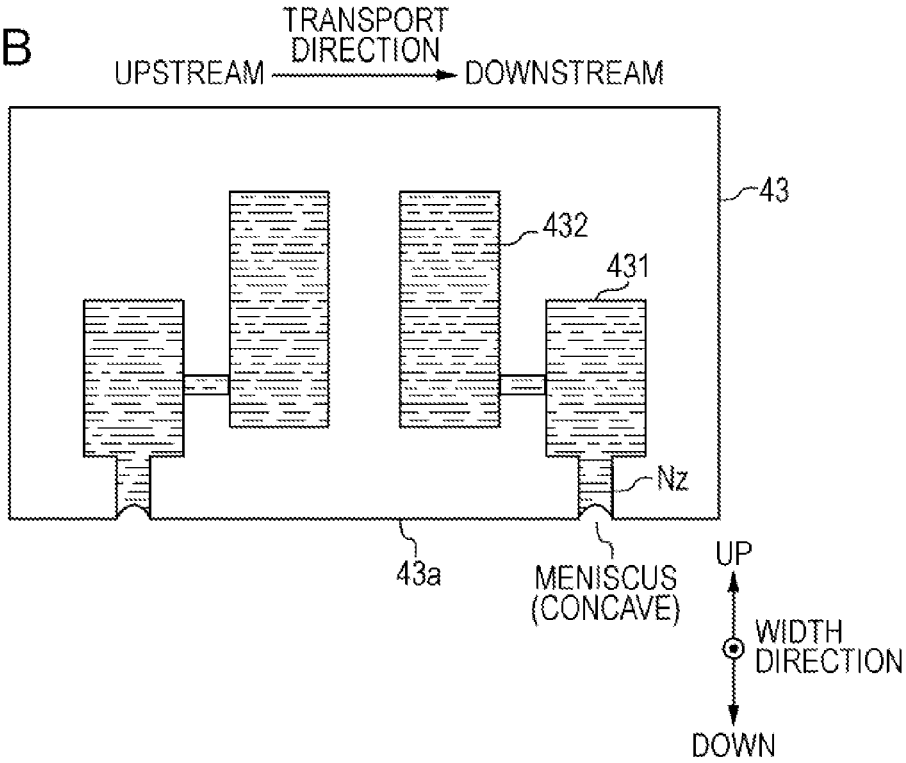

FIG. 5 is a flowchart illustrating a method of cleaning the heads 43 according to a first embodiment, and FIGS. 6A and 6B are views illustrating the method of cleaning the heads 43 according to the first embodiment. As described above, when an image is printed, the circulation pump P rotates at a low speed (the number of rotations is N0), the transfer quantity (q0) of ink per unit time by the circulation pump P is small, and the pressurization of the ink tank 54 performed by the pressure adjustment device 53 is set to the off-state (a state in which the pressure in the ink tank 54 is P0). Therefore, when an image is printed, the state becomes the "low-speed circulation" state in which the flow rate (Q0) per unit time of ink which flows through the circulation flow path is low (S001).

When a predetermined time elapses from a previous process to clean the heads 43, the controller 10 temporarily stops the printing of an image or terminates a printing job which is being executed, and then moves the head unit 41 to the back side such that the heads 43 which are included in the head unit 41 face the caps 51 (S002). Meanwhile, the invention is not limited to the cleaning process which is performed every predetermined time. For example, the cleaning process may be performed whenever an image is printed on a continuous sheet S which has a predetermined length, and the cleaning process may be performed based on the instruction from a user. In addition, the cleaning process may be performed on four head units 41 at the same time, the cleaning process may be sequentially performed for each head unit 41, and the cleaning process may be performed on only the head unit 41 which is being used.

Subsequently, the controller 10 causes the head unit 41 to descend such that the nozzle opening surfaces of the heads 43 adhere to the caps 51, and thus the nozzles Nz are sealed (S003). Further, the controller 10 switches the number of rotations of the circulation pump P from low-speed rotation (N0) to high-speed rotation (N1) (N0<N1) while the pressurization of the ink tank 54 performed by the pressure adjustment device 53 is off, thereby increasing the transfer quantity (q1, corresponding to the first feed rate) of ink per unit time by the circulation pump P compared to the transfer quantity (q0) acquired when an image is printed (q0<q1). In this way, the controller 10 switches the state to a "high-speed circulation" state in which the flow rate (Q1, corresponding to a first flow rate) per unit time of ink which flows through the circulation flow path is greater than the flow rate (Q0) acquired when the low speed circulation is performed (S004, corresponding to a first step). For example, the flow rate (Q1) per unit time of ink which flows through the circulation flow path when the high-speed circulation is performed is set to twice the flow rate (Q0) when the low speed circulation is performed.

However, discharge failure occurs in the nozzles Nz when ink in the nozzles Nz, which has a low frequency of use, is thickened and clogged or when bubbles or thickened ink is contaminated with ink in the head 43 in addition to when contaminants, such as ink, adhere to the nozzle opening surface 43*a* of the head 43. Therefore, when ink in the circulation flow path is circulated at a high speed as described above, bubbles or thickened ink which is contaminated with ink in the head 43, the outgoing tube 55*a*, and the returning tube 55*b* is transmitted to the ink tank 54 together with normal ink. In the ink tank 54, bubbles pop on the liquid surface of ink and disappear or thickened ink settles, and thus it is difficult for the thickened ink to be supplied from the outgoing tube 55*a* to the head 43. Therefore, the discharge failure of the nozzles Nz is solved.

Subsequently, the controller 10 sets the pressurization of the ink tank 54 performed by the pressure adjustment device 53 to an on-state while the number of rotations of the circulation pump P is set to the high-speed rotation (N1), thereby causing pressure (P0+α) in the ink tank 54 to be higher than pressure (P0) acquired when an image is printed (S005). If so, the flow rate (Q2) per unit time of ink which flows through the circulation flow path is further increased compared to Q1 acquired in step S004 (Q1<Q2). Therefore, pressure which is applied to ink in the circulation flow path (in the head 43) is further increased compared to pressure acquired in step S004. In this state, the controller 10 causes the head unit 41 to ascend, thereby separating the caps 51 from the head 43 (S006). If so, since pressure is strongly applied to ink in the head 43, thickened ink and bubbles are released from the nozzles Nz, together with normal ink. The discharge failure of the nozzles Nz is solved with the process.

Thereafter, the controller 10 sets the pressurization of the ink tank 54 performed by the pressure adjustment device 53 to the off-state while the number of rotations of the circulation pump P is set to the high-speed rotation (N1) (S007). If so, the flow rate (Q1) per unit time of ink which flows through the circulation flow path is lower than the flow rate (Q2) acquired in step S005 but is higher than the flow rate (Q0) acquired when an image is printed. Therefore, pressure applied to ink in the head 43 is higher than pressure acquired when an image is printed. As shown in FIG. 6A, although the ink discharge from the nozzles Nz stops, the menisci formed in the nozzles Nz become convex states which protrude outside of the head 43 rather than the nozzle opening surface 43*a* of the head 43.

In this state, the controller 10 causes the tip of the wiper 561 to abut on the nozzle opening surface 43*a* of the head 43, and moves the wiper 561 with regard to the head 43 (head unit 41) from the upstream side to the downstream side in the transport direction, thereby performing the wiping process (S008, corresponding to a second step). Meanwhile, when the rotating drum is used as the platen and the head is inclined along the peripheral surface of the arc shape of the rotating drum, the wiper 561 may be moved toward the downstream side from the upstream side in the gravity direction. In this way, it is possible to suppress bubbles or thickened ink from refluxing into the nozzles Nz.

In this manner, in the first embodiment, the wiping process is performed in the state in which the flow rate (Q1) per unit time of ink which flows through the circulation flow path is set to be higher than the flow rate (Q0) acquired when an image is printed and pressure is applied to ink in the nozzles Nz (in the head 43) to the extent that the menisci formed in the nozzles Nz become the convex states. In this way, even when ink in the nozzles Nz is taken away by the wiper 561, it is possible to replenish ink in the nozzles Nz, and thus it is possible to prevent bubbles from remaining in the nozzles Nz. That is, it is possible to terminate the wiping process in a state in which the nozzles Nz are filled with ink.

Meanwhile, the caps 51 may be separated from the head 43 within predetermined time after the pressurization of the ink tank 54 performed by the pressure adjustment device 53 is set to the off-state. Even in this case, it is possible to release thickened ink or bubbles from the nozzles Nz using residual pressure acquired when pressure is applied to the ink tank 54.

Subsequently, the controller 10 switches the number of rotations of the circulation pump P from the high-speed rotation (N1) to the low-speed rotation (N0) while the pressurization of the ink tank 54 performed by the pressure adjustment device 53 is set to the off-state, thereby setting the transfer quantity (q0, corresponding to a second feed rate) of ink per unit time by the circulation pump P to the same transfer quantity when an image is printed. In this way, the controller 10 switches the state to the "low-speed circulation" state in which the flow rate (Q0, corresponding to the second flow rate) per unit time of ink which flows through the circulation flow path is lower than the flow rate (Q1) acquired when the high-speed circulation is performed (S009, corresponding to a third step). As a result, pressure applied to ink in the head 43 (in the circulation flow path) becomes low. As shown in FIG. 6B, the menisci formed in the nozzles Nz become concave states which are drawn inside of the head 43 than the nozzle opening surface 43*a* of the head 43. That is, menisci formed in the nozzles Nz return to proper states in the case in which the image is printed, and thus it is possible to terminate the cleaning process.

In the end, the controller 10 causes the head unit 41 to ascend with regard to the wiper 561, and moves the head unit 41 on the front side of the width direction such that the head unit 41 faces the continuous sheet S on the platen 42 (S010). In this way, the process of cleaning the head 43 is terminated, and the controller 10 restarts printing the image. At this time, the menisci formed in the nozzles Nz become the concave states. Therefore, it is possible to appropriately control the discharge or the non-discharge of ink using the piezoelectric elements, and thus it is possible to suppress the quality of the printed image from deteriorating.

As described above, in the first embodiment, the wiping process is performed in such a way that the transfer quantity of ink by the circulation pump P is increased (q0→q1) and the flow rate per unit time of ink which flows through the circulation flow path is increased compared to when an image is printed (Q0→Q1). In this way, it is possible to perform the wiping process in the state in which pressure is applied to ink in the nozzles Nz (in the heads 43). Even when ink in the nozzles Nz is wiped away by the wiper 561, ink is replenished in the nozzles Nz from the ink chambers 431, and thus it is possible to terminate the wiping process in a state in which the nozzles Nz are filled with ink. In particular, the wiping is performed in a state in which pressure is applied to ink in the nozzles Nz (in the head 43) to the extent that menisci formed in the nozzles Nz protrude outside of the head 43 rather than the nozzle opening surface 43*a* of the head 43, and thus it is possible to more certainly replenish the nozzles Nz with ink.

In addition, in the first embodiment, after the wiping process is performed, the transfer quantity of ink by the circulation pump P is decreased (q1→q0). In this way, it is possible to cause the flow rate (Q0) per unit time of ink which flows through the circulation flow path to be lower than the flow rate (Q1) acquired when the wiping process is performed, and thus it is possible to cause menisci formed in the nozzles Nz to reach proper states when an image is printed, that is, states in which the menisci are drawn inside of the head 43 than the nozzle opening surface 43*a* of the head 43. That is, it is possible to terminate the cleaning process by causing the nozzles Nz to be in states in which ink can be appropriately discharged.

In addition, the flow rate per unit time of ink which flows through the circulation flow path after the wiping process is performed is equal to the flow rate (Q0) per unit time of ink which flows through the circulation flow path when an image is printed. In this way, it is possible to start a printing operation immediately after the process of cleaning the head 43 is terminated. That is, the step S009 after the wiping process is performed corresponds to a preparation operation for printing. However, the invention is not limited thereto. If the flow rate per unit time of ink which flows through the circulation flow path after the wiping process is performed is lower than the flow rate in the case in which the high-speed circulation is performed, the flow rate may be different from the flow rate when an image is printed.

Meanwhile, the invention is not limited to the fact that the number of rotations of the circulation pump P is switched from the high-speed rotation to the low-speed rotation after the wiping process is performed. The wiping process may be performed within predetermined time after the number of rotations of the circulation pump P is switched from the high-speed rotation to the low-speed rotation. Even in this case, with the residual pressure acquired when high-speed circulation is performed, it is possible to perform the wiping process in a state in which the flow rate per unit time of ink which flows through the circulation flow path is high compared to when an image is printed. That is, it is possible to perform the wiping process in the state in which pressure is applied to ink in the nozzles Nz (in the head 43). Therefore, even when ink in the nozzles Nz is wiped away by the wiper 561, the ink chambers 431 in the nozzles Nz are replenished with ink, and thus it is possible to terminate the wiping process in a state in which the nozzles Nz are filled with ink.

In addition, after the caps 51 adhere to the head 43 and pressurization in the ink tank 54 is set to the on-state, the process to separate the caps 51 from the head 43 and to release thickened ink or bubbles from the nozzles Nz may not be performed and only the wiping process may be performed in a state in which the high-speed circulation is performed. In addition, the invention is not limited to the fact that pressurization in the ink tank 54 performed by the pressure adjustment device 53 is set to the on-state after the circulation pump P is rotated at a high-speed in the state in which the caps 51 adhere to the head 43. The flow rate per unit time of ink which flows through the circulation flow path may be increased by further increasing the number of rotations of the circulation pump P. Even in this case, it is possible to release thickened ink or bubbles from the nozzles Nz after the caps 51 are separated from the head 43.

Second Embodiment

Figure 7:
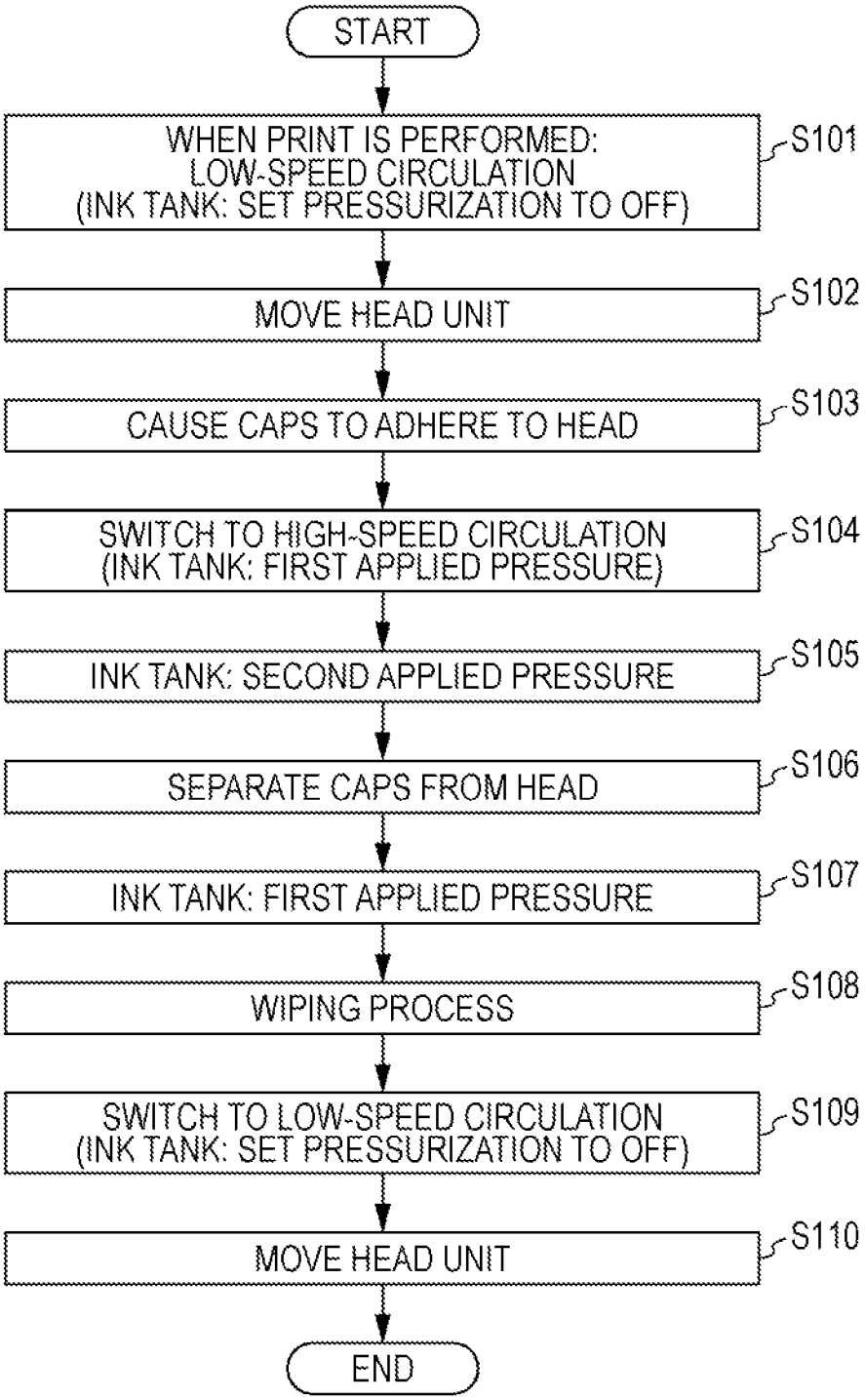
FIG. 7 is a flowchart illustrating a method of cleaning a head according to a second embodiment.

FIG. 7 is a flowchart illustrating the method of cleaning the heads 43 according to a second embodiment. In the second embodiment, the number of rotations of the circulation pump P, that is, the transfer quantity of ink per unit time by the circulation pump P is set to be uniform, and the pressure adjustment device 53 adjusts pressured in the ink tank 54, thereby controlling the ink discharge from the nozzles Nz or the states of menisci. Conditions required when an image is printed are the same as in the first embodiment. That is, the circulation pump P rotates at a low speed (N0), the transfer quantity (q0) of ink per unit time by the circulation pump P is small, the pressurization of the ink tank 54 performed by the pressure adjustment device 53 is set to the off-state (a state in which pressure in the ink tank 54 is P0), and thus the state becomes the "low-speed circulation" state in which the flow rate (Q0) per unit time of ink which flows through the circulation flow path is low (S101). First, in order to clean the head 43, the controller 10 moves the head unit 41 (S102), and thus caps 51 adhere to the head 43 (S103).

Subsequently, the controller 10 sets the pressure in the ink tank 54 to "first applied pressure (P1, corresponding to first pressure)" which is higher than pressure (P0) when an image is printed (P1>P0) using the pressure adjustment device 53. In this way, the state becomes the "high-speed circulation" state in which the flow rate (Q1) per unit time of ink which flows through the circulation flow path is higher than the flow rate (Q0) acquired when the low speed circulation is performed (S104, corresponding to a first step). Therefore, it is possible to cause bubbles or thickened ink in the circulation flow path to flow into the ink tank 54. Thereafter, the controller 10 sets the pressure in the ink tank 54 to "second applied pressure (P2, corresponding to second pressure" which is further higher than pressure acquired in S104 (P2>P1) using the pressure adjustment device 53. In this way, the flow rate (Q2) per unit time of ink which flows through the circulation flow path is further increased than the flow rate (Q1) acquired in S104 (Q1<Q2). In the state, the controller 10 causes the caps 51 to be separated from the head 43 (S106). If so, since pressure is strongly applied to ink in the head 43, it is possible to release thickened ink or bubbles from the nozzles Nz.

Thereafter, the controller 10 returns the pressure of the ink tank 54 to the "first applied pressure (P1)" which is lower than the case of S105 and is the same as pressure of the case of switching to the high-speed circulation (the case of S104) using the pressure adjustment device 53 (S107). If so, the flow rate (Q1) per unit time of ink which flows through the circulation flow path is lower than the case of S105 (Q2) but is higher than the flow rate (Q0) when an image is printed. Therefore, pressure applied to ink in the head 43 is higher than when an image is printed. Accordingly, although ink discharge from the nozzles Nz stops, menisci formed in the nozzles Nz become the convex states (FIG. 6A). In this state, the controller 10 causes the wiper 561 to perform wiping process (S108, corresponding to a second step). In this way, even when ink in the nozzles Nz is taken away by the wiper 561, it is possible to replenish the nozzles Nz with ink by replenishing the nozzles Nz with ink from the ink chambers 431, and thus it is possible to terminate the wiping process in a state in which the nozzles Nz are filled with ink.

Subsequently, the controller 10 sets the pressurization of the ink tank 54 performed by the pressure adjustment device 53 to the off-state, and returns the pressure in the ink tank 54 to the pressure (P0, corresponding to a second pressure) when an image is printed, which is lower than the first applied pressure (P1) acquired in S104. In this way, the controller 10 returns the flow rate (Q0) per unit time of ink which flows through the circulation flow path to the low-speed circulation state which is lower than the flow rate (Q1) acquired when the high-speed circulation is performed (S109, corresponding to a third step). In the end, the controller 10 moves the head unit 41 (S110), and restarts printing the image. At this time, the menisci formed in the nozzles Nz become the concave states, and thus it is possible to appropriately control the discharge or the non-discharge of ink using the piezoelectric elements.

Meanwhile, the wiping process may be performed within a predetermined time after the pressurization of the ink tank 54 performed by the pressure adjustment device 53 is set to the off-state. Even in this case, it is possible to perform the wiping process in the state in which the flow rate per unit time of ink which flows through the circulation flow path is higher than the flow rate when an image is printed due to residual pressure acquired when pressure is applied to the ink tank 54. Therefore, it is possible to terminate the wiping process in the state in which the nozzles Nz are filled with ink.

Other Embodiment

The above embodiments are provided to easily understand the invention and do not limit the interpretation of the invention. The invention may be modified and amended without departing the gist thereof, and the invention includes the equivalents thereof.

In the embodiment, an example of the printer 1 is shown that prints a 2-dimensional image by discharging ink from the head unit 41 to the recording medium which is transported without stopping under the head unit 41, in which the nozzles Nz are arranged and fixed, through the length which is equal to or greater than the width direction of the recording medium. However, the invention is not limited thereto. The invention may be applied to, for example, a printer that repeats an operation of printing a 2-dimensional image in such a way that one or more heads discharge ink to a recording medium positioned in a printing area while moving in the X direction and moving in the Y direction, and an operation of transporting the recording medium in the X direction and supplying a new portion of the recording medium to the printing area. In addition, the invention may be applied to, for example, a printer that repeats an operation of discharging ink while one or more heads move in a direction which is perpendicular to a nozzle row direction (the width direction of the recording medium), and a transport operation of transporting the medium in the nozzle row direction (direction in which the medium is continued when the recording medium is a continuous medium). In addition, the invention may be applied to, for example, a printer that repeats an operation of discharging ink to a recording medium which moves in the X direction with regard to one or more heads, and an operation of moving the recording medium in the Y direction with regard to the heads.

Although an ink jet printer is exemplified as an example of the liquid discharging apparatus in the embodiment, the invention is not limited thereto. For example, a liquid discharging apparatus, such as a color filter manufacturing apparatus, a display manufacturing apparatus, a semiconductor manufacturing apparatus, and a DNA chip manufacturing apparatus, may be used.

The entire disclosure of Japanese Patent Application No. 2013-065769, filed Mar. 27, 2013 is expressly incorporated by reference herein.

What is claimed is:

1. A head cleaning method in a liquid discharging apparatus which includes a head that is provided with nozzles which discharge liquid to a recording medium, a storage section that stores the liquid, a circulation flow path that includes a first flow path which supplies the liquid from the storage section to the head and a second flow path which refluxes the liquid from the head to the storage section, a pump that circulates the liquid in the circulation flow path, and a wiping section that performs a wiping process to wipe off contaminants which adhere to a nozzle opening surface by relatively moving with regard to the head while being abutted on the nozzle opening surface of the head, the head cleaning method comprising:

a first step of setting a flow rate per unit time of the liquid which flows through the circulation flow path to a first flow rate by increasing a number of rotations of the pump, wherein the first flow rate is greater than a flow rate in a case in which the liquid is discharged to the recording medium;

a second step of the wiping section performing the wiping process after the first step, wherein the wiping process is performed while the liquid flows through the circulation path at the first flow rate due to the continuing increased number of rotations of the pump to thereby provide pressure to the head; and a third step of setting the flow rate per unit time of the liquid which flows through the circulation flow path to a second flow rate which is lower than the first flow rate after the second step by lowering the rotations of the pump.

2. The head cleaning method according to claim 1, wherein the second step includes causing menisci of the liquid formed in the nozzles to protrude outside of the head rather than the nozzle opening surface, and wherein the third step includes causing the menisci to be drawn inside of the head rather than the nozzle opening surface.

3. The head cleaning method according to claim 1, wherein the flow rate per unit time of the liquid which flows through the circulation flow path in a case in which the liquid is discharged to the recording medium is equal to the second flow rate.

4. The head cleaning method according to claim 1, wherein the first step includes setting the flow rate per unit time of the liquid which flows through the circulation flow path to the first flow rate by setting a feed rate of the liquid by the pump to a first feed rate, and wherein the third step includes setting the feed rate of the liquid by the pump to a second feed rate which is lower than the first feed rate.

5. The head cleaning method according to claim 1, wherein the liquid discharging apparatus includes a pressure adjustment section that adjusts pressure in the storage section, wherein the first step includes setting the flow rate per unit time of the liquid which flows through the circulation flow path to the first flow rate by setting the pressure in the storage section to first pressure by the pressure adjustment section, and wherein the third step includes setting the pressure in the storage section to second pressure which is lower than the first pressure by the pressure adjustment section.

6. A liquid discharging apparatus comprising:

a head that is provided with nozzles which discharges liquid to a recording medium;

a storage section that stores the liquid;

a circulation flow path that includes a first flow path which supplies the liquid from the storage section to the head and a second flow path which refluxes the liquid from the head to the storage section;

a pump that circulates the liquid in the circulation flow path;

a wiping section that performs a wiping process to wipe off contaminants which adhere to a nozzle opening surface by relatively moving with regard to the head while being abutting on the nozzle opening surface of the head; and a control section that sets a flow rate per unit time of the liquid which flows through the circulation flow path to a first flow rate by increasing a number of rotations of the pump, wherein the first flow rate is greater than a flow rate in a case in which the liquid is discharged to the recording medium, and causes the wiping section to perform the wiping process thereafter, wherein the wiping process is performed while the liquid flows through the circulation path at the first flow rate due to the continuing increased number of rotations of the pump to thereby provide pressure to the head, and sets the flow rate per unit time of the liquid which flows through the circulation flow path to a second flow rate which is lower than the first flow rate by lowering the rotations of the pump.

* * * * *